US007532174B2

(12) United States Patent
Luk

(10) Patent No.: US 7,532,174 B2
(45) Date of Patent: May 12, 2009

(54) PROGRAMMABLE DRIVERS FOR DISPLAY DEVICES

(75) Inventor: Kwok Hong Luk, Hong Kong (CN)

(73) Assignee: TPO Hong Kong Holding Limited, Shatin (HK)

( * ) Notice: Subject to any disclaimer, the term of this patent is extended or adjusted under 35 U.S.C. 154(b) by 292 days.

(21) Appl. No.: 10/511,868

(22) PCT Filed: Apr. 16, 2003

(86) PCT No.: PCT/IB03/01563

§ 371 (c)(1),
(2), (4) Date: Oct. 16, 2004

(87) PCT Pub. No.: WO03/090199

PCT Pub. Date: Oct. 30, 2003

(65) Prior Publication Data

US 2005/0169069 A1 Aug. 4, 2005

(30) Foreign Application Priority Data

Apr. 19, 2002 (EP) ..... 02076545

(51) Int. Cl.
*G09G 5/00* (2006.01)

(52) U.S. Cl. ..... 345/3.1; 345/204; 345/522; 710/20

(58) Field of Classification Search ..... 345/3.1, 345/522, 204; 710/20, 21, 16
See application file for complete search history.

(56) References Cited

U.S. PATENT DOCUMENTS 6,085,098 A * 7/2000 Moon et al. ..... 455/457
2001/0004257 A1 * 6/2001 Nitta et al. ..... 345/211

FOREIGN PATENT DOCUMENTS

EP 1 111 572 6/2001
JP 11231994 A 8/1999
JP 2000194346 A 7/2000

* cited by examiner

*Primary Examiner*—Sumati Lefkowitz
*Assistant Examiner*—Seokyun Moon
(74) *Attorney, Agent, or Firm*—Lowe Hauptman Ham & Berner, LLP

(57) ABSTRACT

A display device (panel) is made recognizable by an application (11) in an electronic apparatus. This enables the application to use otherwise dummy lines (L1 . . . L22) during start up to be used to program configuration parameters (parameters like display length and width, TFT-driving parameters like pulse widths etc.).

14 Claims, 5 Drawing Sheets

PROGRAMMABLE DRIVERS FOR DISPLAY DEVICES

Figure 1A:
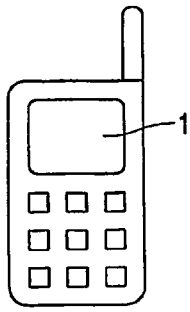

The invention relates to an electronic apparatus suitable for displaying information via a display device, the display device having a display panel provided with driving electronics.

The invention furthermore relates to a method for programming a controller for a display device for at least one application and to a display device.

The display device may belong to one of the groups of liquid crystal display devices, electrochromic display devices, electrophoretic display devices, reflective display devices including an interferometric modulator and luminescent display devices. Examples of such active matrix display devices are TFT-LCDs or AM-LCDs, which are used in laptop computers and in organizers, but also find an increasingly wider application in GSM telephones.

Such matrix displays are generally addressed by means of selection lines which periodically address (a group of) selection lines or rows, via switches such as TFT (MOS)-transistors, while at the main time data (voltages) are provided via (a group of) data lines or columns.

The liquid crystal display device (LCD) is usually a self-contained module, with associated electronics, which is built into a module. The interface signal between the module and the electronic apparatus application is usually a standard one. It generally comprises at least the following signals:

- a vertical synchronization pulse (the signal that aligns the display information within a frame)
- a horizontal synchronization pulse (the signal that aligns the display information within a line)
- pixel clock signals (the clock that aligns the display information with the pixel)
- RGB digital display data. Depending on the number of colors for the display, this can be a data bus of width 12 (4 bit/color) to 24 bits (8 bits/color)

One problem associated with these kind of interfaces is the fact that a certain liquid crystal display device, which the display manufacturer preferably manufactures in large volume does not within the electronic apparatus, automatically fit to a certain application in said apparatus. It may for instance occur that within a number of different applications 220, 240 and 260 rows may be used while the number of columns varies between 150 and 180 dependent on the application. This implies that in some applications a number of lines and/or columns should remain idle.

The associated electronics of the display device comprise driver circuits like row drivers and column drivers. In active matrix liquid crystal display devices (AMLCD panels) these row drivers and column drivers are connected to gates and sources of thin film transistors (TFTs). The drivers generally are driven by some dedicated control signals. As a result, some kind of "controller" is required on the module to generate these signals from the input synchronization pulses and pixel clock. Such controller is generally realized with an application-specific integrated circuit (ASIC).

A main problem is the fact that the number of lines and columns within liquid crystal display devices manufactured in large volume does not correspond to the number of lines and columns within electronic apparatuses related to different applications. This implies that the control signals, associated with a number of timing parameters, need to be changed from one display device (AMLCD panel) to another. For instance, when the number of lines and columns within the display application of the LCD panel is different from one application to another, parameters and hence control signals have to be modified. In this case a new ASIC needs to be made for every application, leading to extra initial costs and inventory control. A number of possible alternatives can be thought of e.g.

- incorporating nonvolatile memory to store such parameters. The memory is pre-programmed in the factory. This adds per-unit cost of the device
- use of input pins connection to select between different applications. This makes the device only usable for those specific applications and hence is not flexible enough
- use of a single metal mask for configuring the parameters. This lowers the initial cost and lead-time but does not overcome the inventory problem.

It is one of the objects of the invention to overcome at least partly the above mentioned problem. To this end an electronic apparatus according to the invention comprises a controller for selecting at least one application for the display device and further comprises memory means for storing display parameters related to said application and means for providing said display parameters to an interface between the electronic apparatus and the display device, the display parameters belonging to the group of number comprising the number of lines to be displayed, the number of columns to be displayed, parameters related to driving transistors or power saving parameters.

The invention is based on the insight that for almost all applications, the number of lines (and columns) as used in the application is less than the number of lines (and columns) within the display device. As a result, there will always be a time slot (some line times e.g. immediately after the first vertical pulse) to accommodate a number of dummy line times at the beginning of every frame. Within these dummy line times, the (RGB) data bus does not usually carry any meaningful information and therefore may be exploited to program panel-specific timing parameters as mentioned above into the "controller" (the ASIC). The controller preferably is designed to recognize a special, pre-defined bit pattern in the (RGB) data bus of the first few dummy lines. If such special pattern does not exist, the rest of the dummy lines will remain "dummy" and be ignored. If the pattern is identified, the (RGB) data in the following dummy lines will be timing parameters. The advantages with this approach are

- no dedicated interface is required for the programming of those timing parameters and other parameters. This means minimum impact to the host application
- no extra pin is required on the controller integrated circuit. This is important for space-critical applications, e.g. hand-held devices
- the bit pattern chosen can be made transparent to customers who do not want such a feature.

These and other aspects of the invention are apparent from and will be elucidated with reference to the embodiments described hereinafter.

IN THE DRAWINGS

Figure 1B:
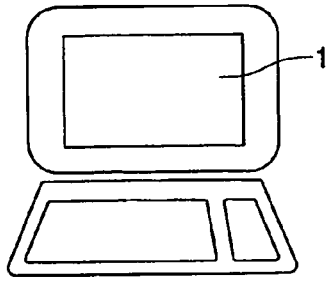
Figure 2:
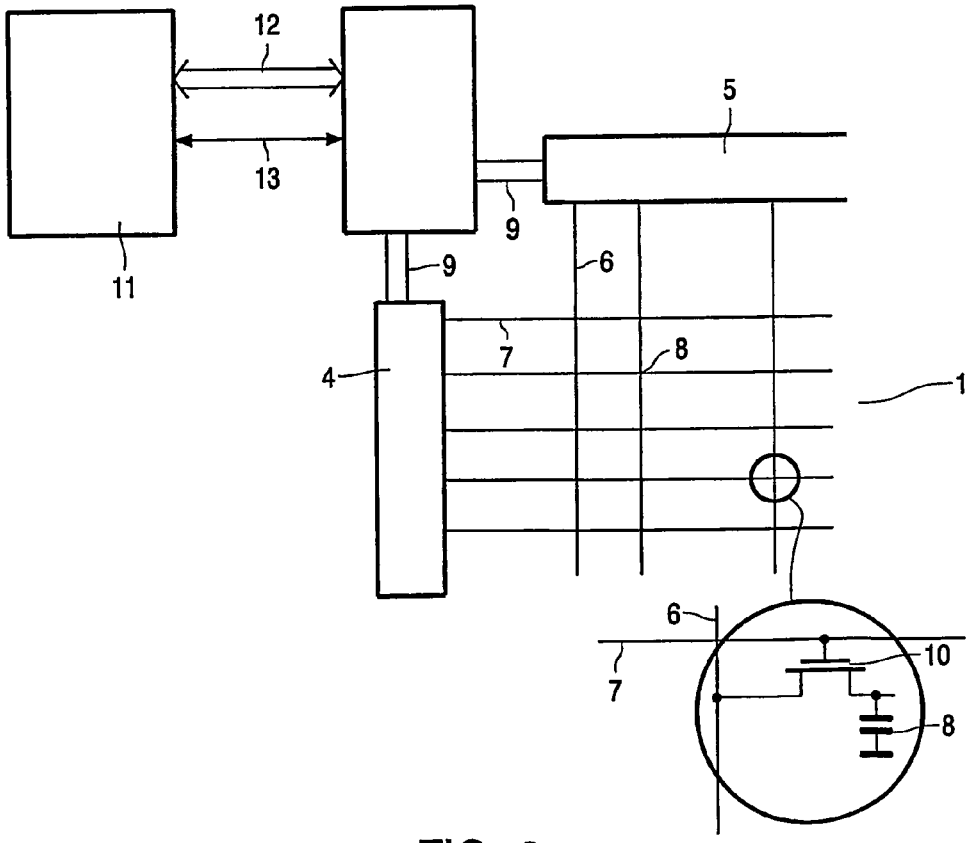
Figure 3A:
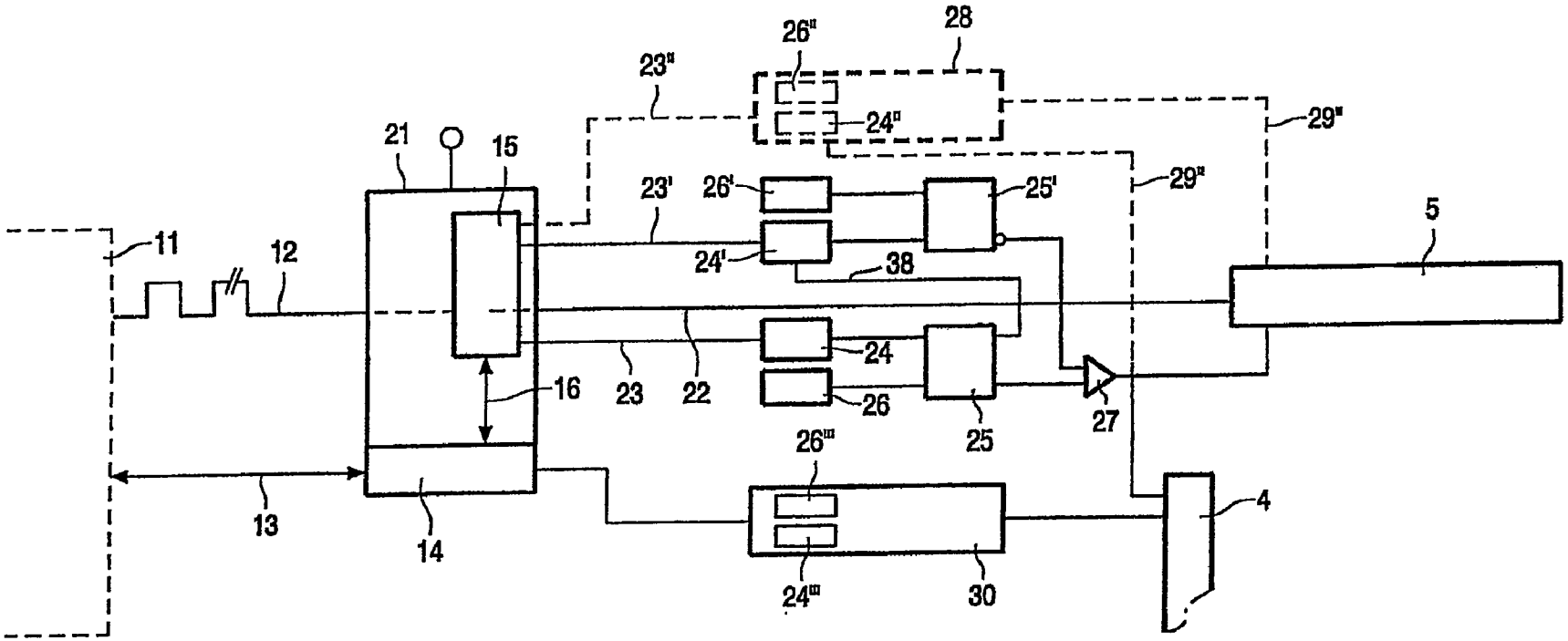
FIG. 3a Prior Art
Figure 3B:
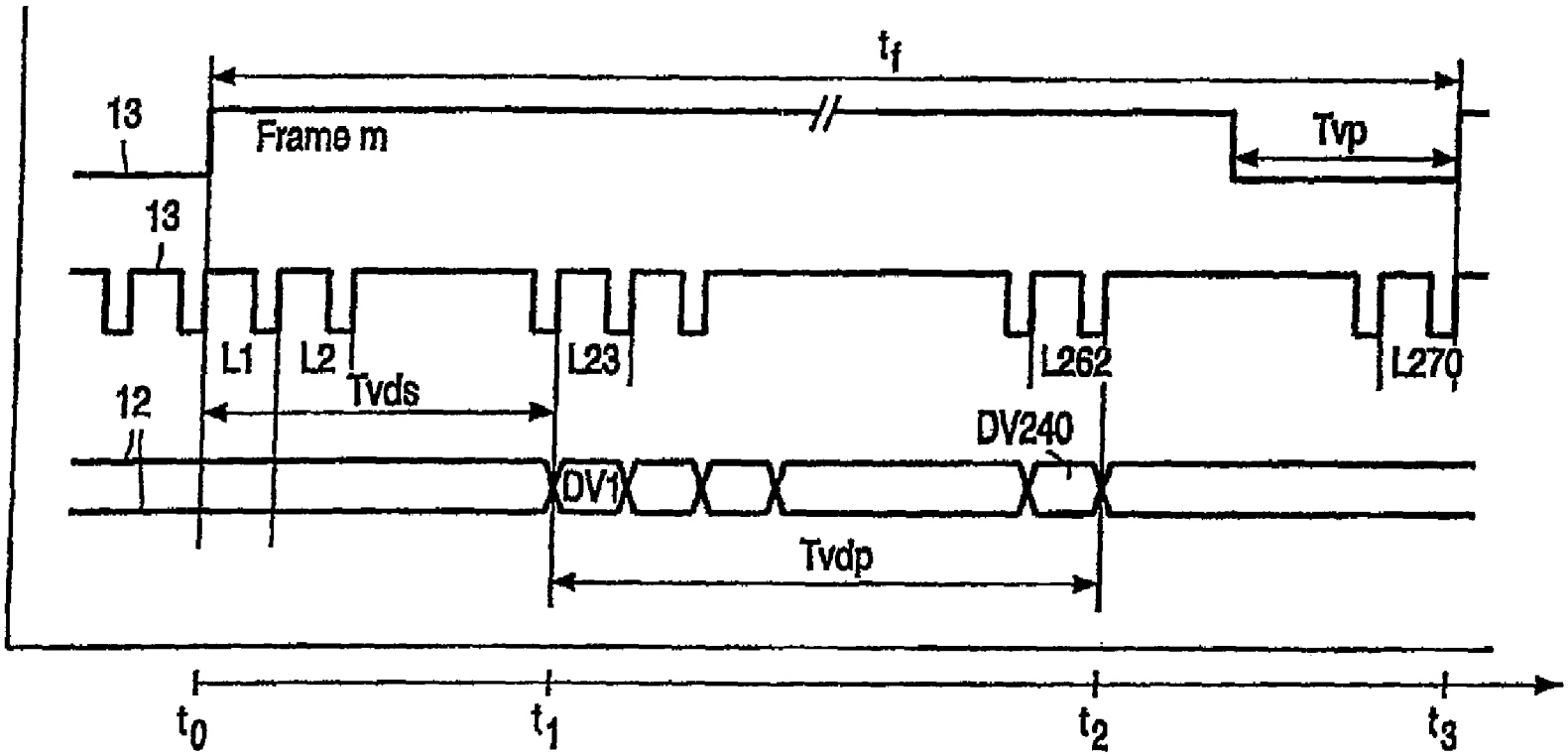
FIG. 3b Prior Art
Figure 4A:
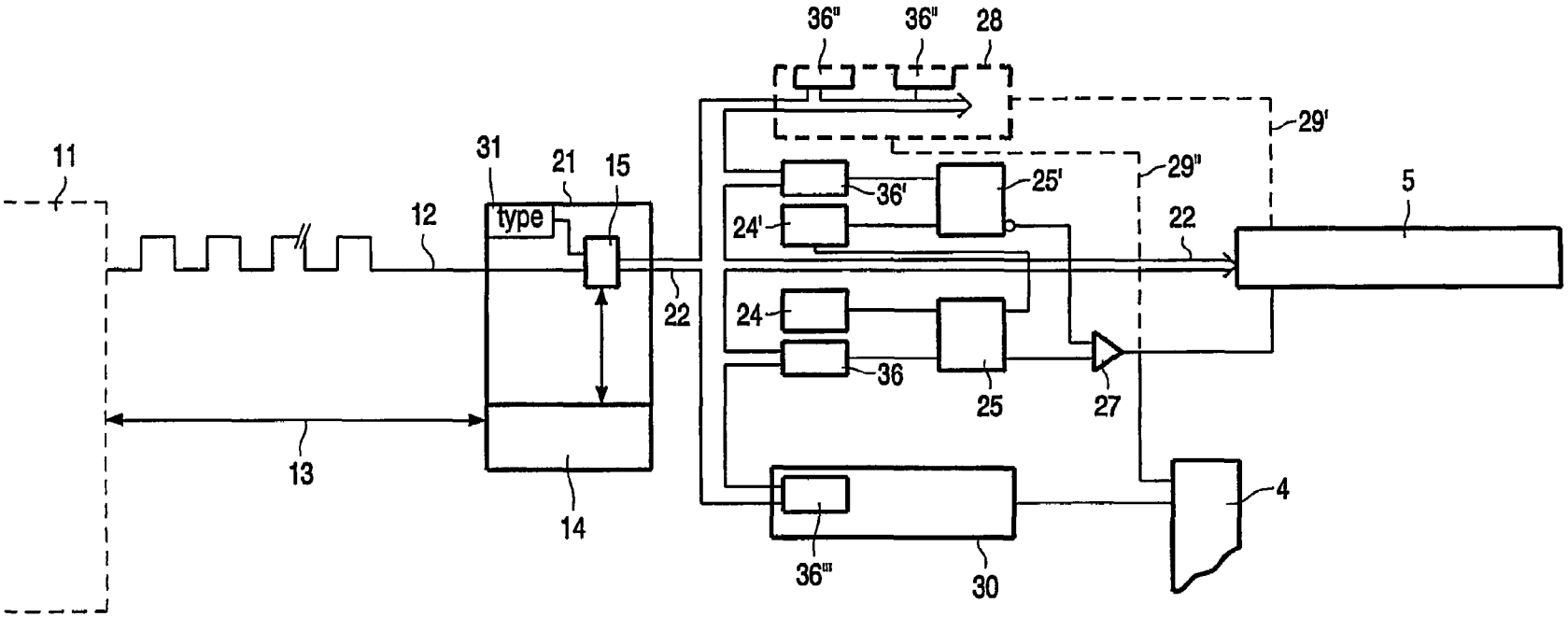
Figure 4B:
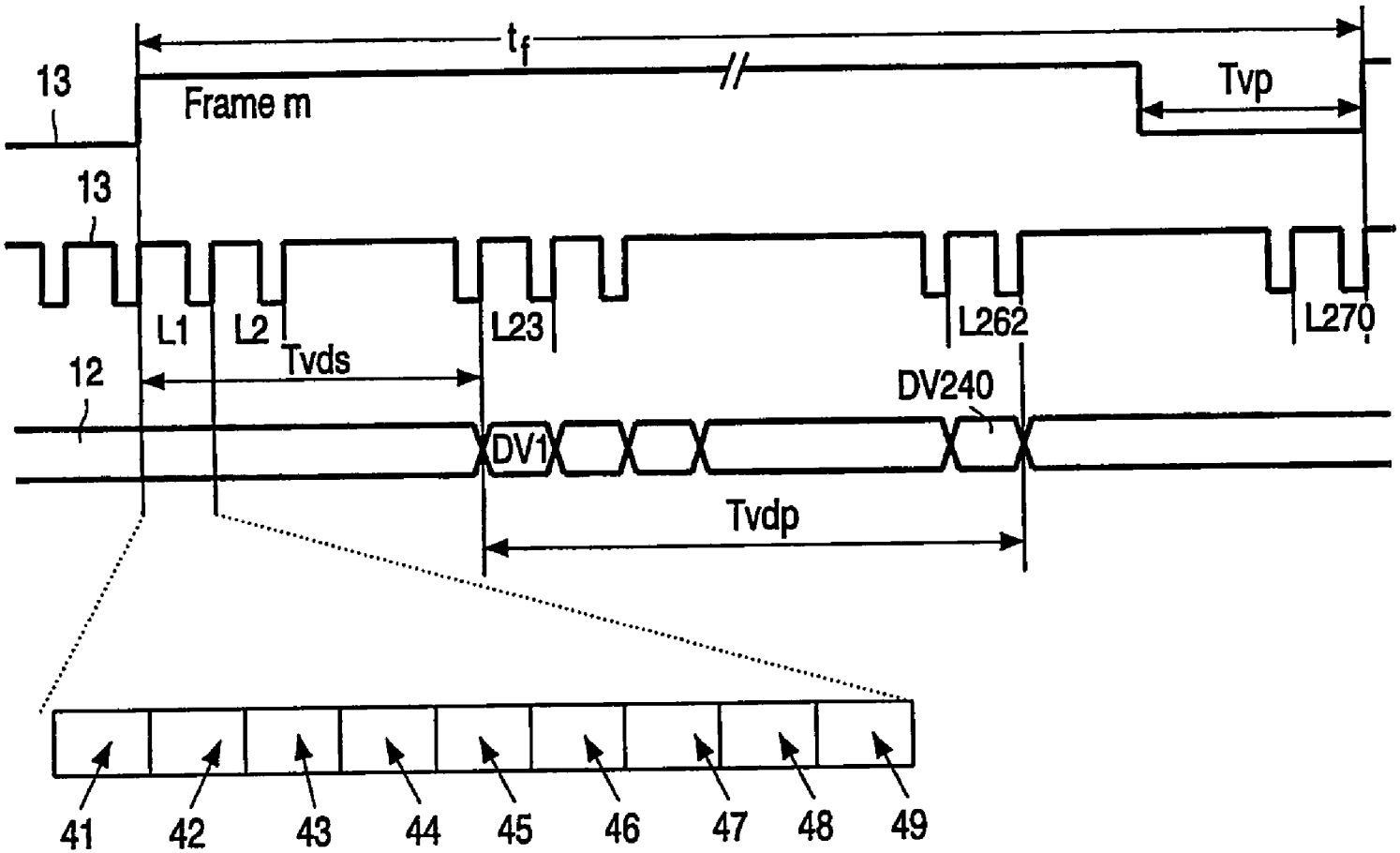

FIGS. 1*a* and 1*b* shows the use of different sizes of display devices in different applications FIG. 2 is an electrical equivalent of a possible embodiment of such a display device, while FIGS. 3*a* and 3*b* is an electrical equivalent of a part of the display device according to the prior art and, FIGS. 4*a* and 4*b* is an electrical equivalent of a part of the display device according to the invention.

The Figures are diagrammatic and not drawn to scale. Corresponding elements are generally denoted by the same reference numerals.

FIG. 1 shows how the size of the actual display panel may vary, dependent on the kind of application. In FIG. $1^a$ one typical example is given viz. the use of displays in mobile telephones. A typical display device (panel) 1 in these applications has dimensions of about 2 cm×4 cm, whereas the number of lines may vary between 50 and 100 while the number of columns may vary between 100 and 200. In FIG. $1^b$ another example is given viz. the use of displays in portable computers. A typical display device (panel) in these applications has dimensions of about 20 cm×30 cm, whereas the number of lines may vary between 250 and 300 while the number of columns may vary between 200 and 400.

FIG. 2 is an electric equivalent circuit diagram of a part of a display device 1 to which the invention is applicable. It comprises in one possible embodiment (one mode of driving, called the "passive mode") a matrix of pixels 8 defined by the areas of crossings of row or selection electrodes 7 and column or data electrodes 6. The row electrodes are consecutively selected by means of a row driver 4, while the column electrodes are provided with data via a data register 5. To this end, incoming data 2 are first processed, if necessary, in a processor 3. Mutual synchronization between the row driver 4 and the data register 5 takes place via drive lines 9.

In another possible embodiment (another mode of driving, called the "active mode"), shown in detail for one crossing one pixel only, signals from the row driver 4 select the picture electrodes via thin-film transistors (TFTs) 10 whose gate electrodes are electrically connected to the row electrodes 7 and the source electrodes are electrically connected to the column electrodes 6. The signal that is present at the column electrode 6 is transferred via the TFT 10 to a picture electrode of a pixel 8 coupled to the drain electrode. The other picture electrodes are connected to, for example, one (or more) common counter electrode(s). In FIG. 2 only one thin-film transistor (TFTs) 10 has been drawn, simply as an example.

Input data to the driver 3, comprising data signals 12, and timing and synchronizing signals 13 are available from a processor 11, whose function and architecture is dependent on the kind of application to which the display device is assigned (e.g. a mobile phone processor or a computer processor). Said signals, together with a part of the driver 3 are shown in FIG. 3 for a part of a display device according to the prior art. For the clarity of explanation it is supposed that the available number of rows for the actual display device (panel) is 240 and that the available number of columns is 200.

The application as designed in the processor 11 however, in this example supplies 270 line selection times within one frame time $t_f$. This implies that a number of rows should not be provided with data signals 12 (in this example the first 22 rows L1, L2, . . . L22 during interval Tvds and the last 8 rows L263, L264 . . . L270 of the display device (panel), as shown in FIG. 3(*b*)). Also it could be necessary that during selection of a row a number of columns should have a defined value or not be activated at all in this example.

In the prior art device of FIG. 3(*a*) data signals 12, and timing and synchronizing signals 13 are processed (schematically shown by boxes 14, 15 and double-arrow 16 in a part 21 of driver 3) to generate a data stream 22 and timing signals 23 of a first frequency as well as timing signals 24 of a second frequency. The synchronizing signals and timing signals are derived from a (not shown) system clock signal. Signals 23 at time $t_0$ start a counting circuit 24. The content of counting circuit 24 is compared in comparator 25 to a fixed value (in this example 22) stored in e.g. a ROM-circuit 26. As soon as the content of counting circuit 24 reaches 22 (at time $t_1$) the outputs of comparator 25 are activated. One of the outputs in this example, via line 38 starts a second counting circuit 24'. The content of counting circuit 24' is compared in comparator 25' to another fixed value (in this example 240) stored in e.g. another ROM-circuit 26'(or part of the same ROM-circuit 26). It will be clear that it is also possible to delete line 26 and use 262 as the other fixed value stored in ROM-circuit 26'.

In the present example however the row driver 4 and the data register 5 have to be enabled during the period $t_1$-$t_2$ (i.e. during lines L23, L24, . . . . L262, time period Tvdp in FIG. 3(*b*)), which is accomplished by the AND function 27 of the output of comparator 25 and the inverse output of comparator 25'. For simplicity and since this is not a part of the invention further functional circuitry in the driver 3 to ensure certain delays and resetting of counters etcetera is not shown in FIG. 3(*a*). The same holds for synchronizing and/or other timing circuitry (e.g. in part 21).

If necessary, in a similar way the enabling of a number of columns can be set to a defined value by schematically shown circuit 28, having one or more ROM-circuit 26" and counters 24" and dashed synchronizing and control lines 23", 29".

Also in a similar way timing signals 24 may be counted in circuit 30 (having one or more ROM-circuit 26'"and counters 24'"), in which multiple of e.g. a clock period may be determined to set values for parameters used to drive the row driver 4, such as a) Gate select width—during operation, the row driver 4 supplies selection pulses within each row to the TFTs 10 to turn the TFTs on and apply the appropriate voltages to the pixels. The duration of such an electrical pulse depends on some physical characteristics of the display device (panel) as well as the row driver 4 being used.

b) Gate enable width—the selection pulse as mentioned above may need to be suppressed within a short time period to avoid selection pulses for two consecutive rows from overlapping each other, which causes cross-talk. The duration of such enable signal will also be specific for the display device (panel).

c) PS pulse width and location—Some pixels or even columns may not be needed to be driven within the whole frame period $t_f$. A so-called power-saving pulse (PS-pulse) is supplied to the source LCD driver to put its outputs into the so-called "high-impedance" state (a state that does not deliver any electrical current) within the time period of PS-pulse. Power consumption is therefore reduced in this way. The duration and location of said pulse will again be specific for the display device (panel).

In the embodiment of FIG. 3 all parameters described are programmed in advance by programming a certain value into one or more ROM-circuit 26. Since these parameters in general all are specific for the particular application or the display device (panel) this programming has to be done for each new product (and also if a display device (panel) has to be manufactured in a different production line e.g. due to second source requirements).

Said problems have been overcome in the device according to the invention as shown in FIG. 4. The construction of this device is practically similar to the embodiment of FIG. 3, so the same reference numerals have been used. According to the invention however the ROM-circuits 26 have been replaced by e.g. random access memories 36 or registers, whereas the data 22 (shown here as a bus structure) is supplies to all said random access memories 36. Moreover the box (controller) 21 comprises an identification circuit 31 (e.g. a ROM-circuit) which is specific for the display device (panel).

The application as designed in the processor 11 now however during a number of lines (in this example only the first line L1) of interval Tvds provides the driver 3 with application specific parameters and/or panel specific parameter blocks 41-49.

These parameter blocks are provided in a specific sequence, which enables the random access memories 36 to be loaded in the same specific sequence. The sequence itself could be standardized in a protocol to be agreed upon by buyers (application designers) and manufacturers of display devices (panels).

Parameter (data) block 41 for example is a special bit pattern to be recognised by the controller (box) 21. In most applications, up till now the data bus is held at 0 within the first (dummy) lines and so any arbitrary pattern can serve as the special bit pattern. If there is a pattern match, the data in the subsequent parameter (data) blocks 42-9 are interpreted as the parameters mentioned above. If such special pattern does not exist, the rest of the dummy lines will remain "dummy" and be ignored.

Said parameters will then be loaded into the random access memories 36 in the pre-defined sequence as described above. The following is a brief explanation of some parameters:

Block 42 and block 43: display length and display width—they define respectively the display's number of lines and the number of pixels within a line. They should be 240 in the example described above and e.g. 160.

Block 44: number of dummy lines at the beginning of a frame as mentioned above (22 in the example described above).

Block 45: number of dummy pixels inserted at the beginning of each line before the first actual pixel data.

Blocks 46, 47, 48 and block 49 may define gate select width, gate enable width and PS pulse width and location respectively as described above for the embodiment of FIG. 3.

Blocks 47 and 48 for example may refer to different lengths of a pulse width dependent on the kind of manufacturing. For example in a display device (panel) from one manufacturer the gate select should at least be 5 clock pulse, whereas in a display device (panel) from another manufacturer the gate select should at least be 6 clock pulse (e.g. due to some slight differences in manufacturing technology). This implies that the corresponding random access memories 36, related to timing parameters for TFTs 10, as set in block 46 may differ from one manufacturer to another. This determines different values for the identification circuit 3, dependent on the process used. Since the programming of the random access memories 36 is now part of the application (processor 11) some extra memory is needed in the application (processor 11). This however is negligible with respect to the total memory.

It will be clear that such a display device (panel) which is dynamically programmable can easily be adopted to many different applications leading to lower costs, while in most cases off the shelf display devices (panels) can be used.

The protective scope of the invention is not limited to the embodiments described, while the invention is also applicable to other display devices, for example, (O) LED displays, and other display devices in which parameters may change dependent on the application.

While in the example all blocks 41-49 are provided during one line only (the first line L1) of interval Tvds, it will be clear that said parameters can be provided during a number of lines of interval Tvds.

On the other hand the electronic apparatus comprising the display device (panel) may be suited for different applications (e.g. both a telephone application and a calculator application) which each have different parameters (number of lines, number of columns).

The invention resides in each and every novel characteristic feature and each and every combination of characteristic features. Reference numerals in the claims do not limit their protective scope. Use of the verb "to comprise" and its conjugations does not exclude the presence of elements other than those stated in the claims. Use of the article "a" or "an" preceding an element does not exclude the presence of a plurality of such elements.

The invention claimed is:

1. An electronic apparatus for displaying information via a display device, the display device having a display panel provided with driving electronics, the electronic apparatus comprising:

a controller for selecting at least one application for the display device;

a memory for storing at least display parameters related to said application and for providing said display parameters to an interface between the electronic apparatus and the display device, the display parameters comprising at least one of: a number of lines to be displayed, a number of columns to be displayed, parameters related to driving transistors of the display device, and power saving parameters for the display device; and a processor for sending a sequence of data blocks to the controller during a time interval for driving at least one dummy line of a frame, wherein no image data is to be sent to the display device during the time interval for driving said at least one dummy line, wherein one of the data blocks is a predetermined bit pattern to be recognized by the controller, and wherein the display parameters are provided in the remaining data blocks of the sequence;

wherein if the controller does not recognize the predetermined bit pattern, the display parameters provided in the remaining data blocks of the sequence are ignored; and wherein if the controller recognizes the predetermined bit pattern, the display parameters are loaded from the remaining data blocks of the sequence into the memory.

2. The electronic apparatus of claim 1, said display parameters further comprising parameters related to the selection of driving transistors.

3. A display device, comprising:

a display panel provided with driving electronics;

a controller for selecting at least one application for the display device;

a memory for storing at least display parameters related to said application and for providing said display parameters to the driving electronics, the display parameters comprising at least one of: a number of lines to be displayed, a number of columns to be displayed, parameters related to driving transistors of the display device, and power saving parameters for the display devices;

a processor for sending a sequence of data blocks to the controller during a time interval for driving at least one dummy line of a frame, wherein no image data is to be sent to the display panel during the time interval for driving said at least one dummy line, wherein one of the data blocks is a predetermined bit pattern to be recognized by the controller, and wherein the display parameters are provided in the remaining data blocks of the sequence;

wherein if the controller does not recognize the predetermined bit pattern, the display parameters provided in the remaining data blocks of the sequence are ignored; and wherein if the controller recognizes the predetermined bit pattern, the display parameters are loaded from the remaining data blocks of the sequence into the memory.

4. A display device according to claim 3, the driving electronics further comprising a storage for storing the display parameters controlling the display panel received from the memory.

5. The electronic apparatus of claim 1, wherein the display parameters further comprise at least one of: a gate select width, a gate enable width, and a power saving pulse width.

6. A method of an electronic apparatus controlling a display device for at least one application, the method comprising:

programming into a memory of the electronic apparatus display parameters related to the application, the display parameters comprising at least one of: number of lines to be displayed, a number of columns to be displayed, parameters related to driving transistors of the display device, and power saving parameters for the display device;

providing the display parameters from the electronic apparatus to the display device;

sending a sequence of data blocks to a controller of the display device during a time interval for driving at least one dummy line of a frame, wherein no image data is to be sent to the display device during the time interval for driving said at least one dummy line, wherein one of the data block is a predetermined bit pattern to be recognized by the controller of the display device, and wherein the display parameters are provided in the remaining data blocks of the sequence;

if the controller of the display device does not recognize the predetermined bit pattern, ignoring the display parameters provided in the remaining data blocks of the sequence;

if the controller of the display device recognizes the predetermined bit pattern, loading the display parameters from the remaining data blocks of the sequence into a memory of the display device.

7. The method of claim 6, further comprising storing the display parameters in a memory of the display device.

8. The method of claim 6, wherein the display parameters further comprise at least one of: a gate select width; a gate enable width; and a power saving pulse width.

9. The electronic apparatus of claim 1, wherein the controller is adapted to select the one application from a group of applications including both a telephone application and a calculator application.

10. The method of claim 6, wherein the application is one of a telephone application and a calculator application.

11. The method of claim 6, wherein said at least one dummy line includes the first line of said frame.

12. The method of claim 6, wherein said predetermined bit pattern is in the first data block of said sequence.

13. The method of claim 6, wherein the display parameters are provided during a plurality of dummy lines of said frame.

14. The method of claim 6, wherein at least one data block in said sequence defines at least one of the number of dummy lines at the beginning of each frame; and the number of dummy pixels inserted at the beginning of each line before the image data of each frame.

* * * * *